United States Patent [19]

D'Alli

[11] 4,298,229

[45] Nov. 3, 1981

[54] PROCESS FOR DRY MINING PHOSPHATE ORE UTILIZING A SUPERSONIC GAS

[76] Inventor: Sebastian J. D'Alli, 2405 Ixora Ave., Sarasota, Fla. 33580

[21] Appl. No.: 129,615

[22] Filed: Mar. 6, 1980

Related U.S. Application Data

[63] Continuation-in-part of Ser. No. 29,057, Apr. 11, 1979, abandoned, and a continuation-in-part of Ser. No. 882,851, Mar. 2, 1978, abandoned, and a continuation-in-part of Ser. No. 669,711, Apr. 12, 1976, abandoned.

[51] Int. Cl.[3] ..... E21C 41/14

[52] U.S. Cl. ..... 299/7; 209/2; 241/5; 299/18; 405/258; 406/197

[58] Field of Search ..... 299/7–9, 299/18; 209/1, 2, 3, 30, 144; 405/258; 241/5, 19; 406/197

[56] References Cited

U.S. PATENT DOCUMENTS

| | | | |
|---|---|---|---|
| 550,051 | 11/1895 | McKinlay | 299/7 |
| 740,731 | 10/1903 | Beatey | 299/7 X |
| 3,326,474 | 6/1967 | Clary et al. | 241/5 |
| 3,329,355 | 7/1967 | Clary et al. | 241/5 |
| 3,840,188 | 10/1974 | Coombe et al. | 241/5 |
| 3,885,931 | 5/1975 | Schaller | 209/144 X |

*Primary Examiner*—Ernest R. Purser

[57] ABSTRACT

An improved method for mining and processing phosphate matrix in its dry state utilizing a gas moving at supersonic velocity as the carrier fluid to perform the various process steps, in a substantially closed system, that yields dry high grade phosphatic materials and dry sand and clay fractions and to recombine and thoroughly mix the sand and clay fractions in approximately equal proportions by weight as they are produced and to transport the sand-clay mixture along with the naturally radioactive Radon-222 gas that is generated during the processing to the mined out pits and depositing them therein after which the leach zone materials of the overburden are deposited thereover and then depositing thereover the sandy materials of the overburden with provisions being made in preselected areas to form lakes to complete the process of reclaiming the land to its natural state immediately and without danger of radiation from the buried radioactive materials.

5 Claims, 7 Drawing Figures

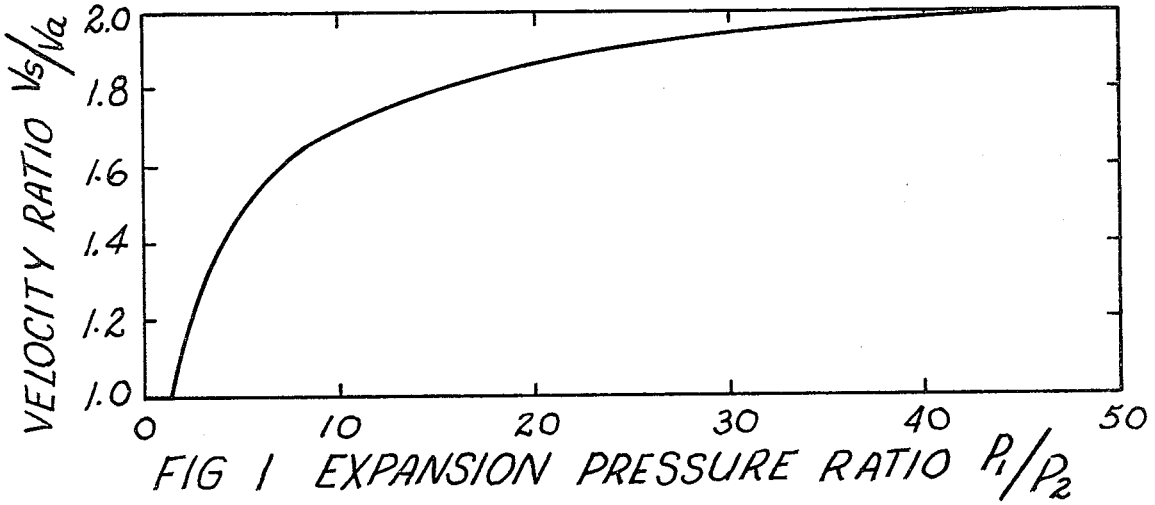
FIG 1
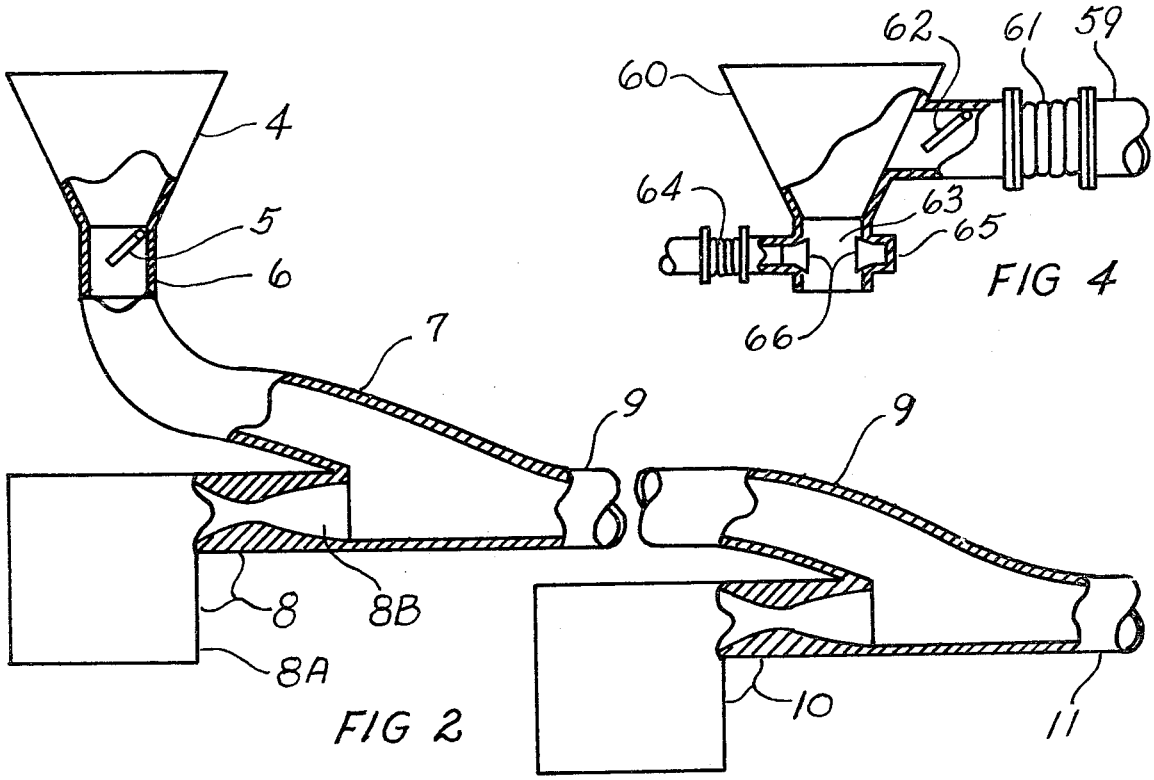
FIG 2
FIG 4
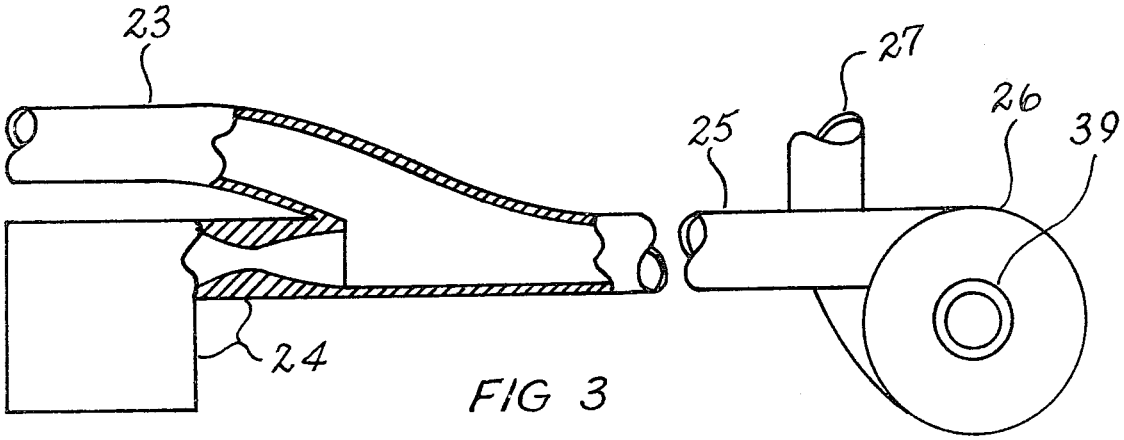
FIG 3

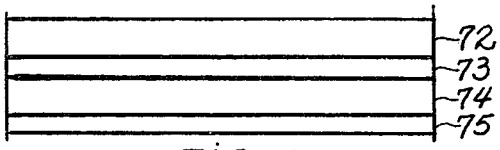
FIG. 6
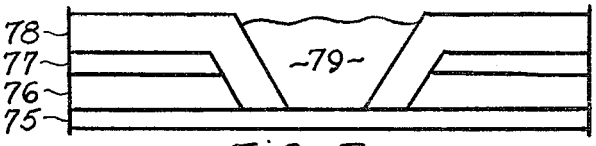
FIG. 7
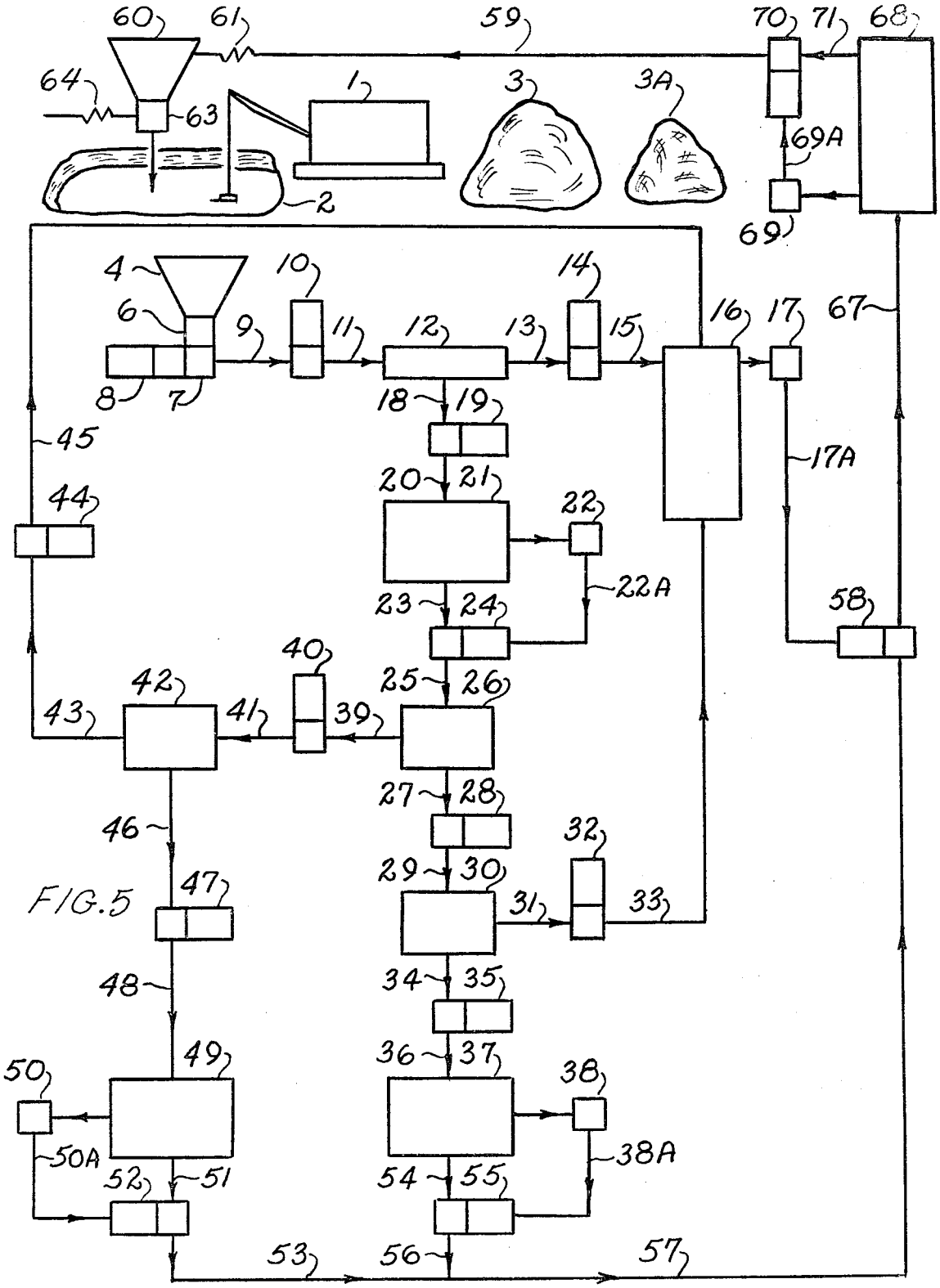

PROCESS FOR DRY MINING PHOSPHATE ORE UTILIZING A SUPERSONIC GAS

BACKGROUND OF THE INVENTION

This application is a continuation-in-part of Ser. No. 029,057 filed Apr. 11, 1979, Ser. No. 882,851 filed Mar. 2, 1978, Ser. No. 669,711 filed Apr. 12, 1976.

In contemporary phosphate mining and processing operations, the overburden is removed with electrically powered draglines to expose the underlying phosphate bearing matrix. The overburden consists of an upper layer of topsoil, a middle layer containing quartz sand and some clayey sand and a lower layer containing quartz sand, clay and, currently non-economic, aluminum phosphates which contain trace amounts of naturally radioactive uranium and its naturally radioactive decay products.

The upper and middle layers are substantially devoid of naturally radioactive materials. They shall henceforth be referred to as the sandy overburden.

The lower layer is known as the aluminum phosphate zone or leach zone. It shall henceforth be referred to as the leach zone overburden.

The matrix contains quartz sand, clay and economic calcium phosphates which also contain naturally radioactive uranium and its naturally radioactive decay products in trace amounts comparable to the trace amounts contained in the leach zone overburden. These calcium phosphates shall henceforth be referred to as phosphate pebbles, phosphatic materials or phosphatic values.

Using said dragline, the overburden is removed and deposited on natural ground adjacent to the mine pit. No attempt is made to separate the sandy overburden from the leach zone overburden. Again, using said dragline, the matrix is removed and deposited in previously prepared sluice pits where it is slurried with water. The slurry is then pumped to a beneficiation plant where processing takes place in three main sections: a washer section wherein the pebble fraction is separated from the flotation feed and clay fracton; a feed preparation section wherein the floatation feed is washed and separated from the clay fraction; and a floatation section wherein the phosphatic values are separated from the sand and other impurities.

These processing operations yield phosphate pebbles and finer phosphatic values, sand and phosphatic clay slimes.

They also result in a redistribution of uranium and its naturally radioactive daughters among the phosphatic materials, the clay slimes and the sand tailings. Approximately 40% of the trace amounts of radioactive substances are in the phosphatic materials, approximately 48% are in the phosphatic clay slimes, and approximately 12% are in the sand tailings.

The clay slimes are pumped to large slime ponds wherein the clay solids are allowed to settle. It often takes 10–15 years for the clay to reach maximum density.

The sand tailings are pumped to land reclamation areas and to clay impoundment areas where they are used to build dams around the perimeter of the clay settling ponds.

The phosphate recovered is approximately two thirds of the amount contained in the original matrix. The remaining one third phosphatic values are entrained in the clay slimes and are currently unrecovered.

A method is needed to recover the one-third phosphatic values now lost to the clay slimes.

The 10–15 year period necessary for the clay to stabilize poses a potential threat of dam failure which would discharge semi-fluid clays containing naturally radioactive materials into public waterways such as rivers and lakes causing extensive water pollution. It is also possible that a rupture could occur at the base of the slime pond which could cause the semi-fluid clays to enter the aquifer.

This unreasonable delay in reclaiming those land areas reserved for the storage of clay slimes is recognized as one of the most technically difficult problems in the industry today.

The industry is seeking an effective solution.

In contempory operations, the phosphate pebble is ground to improve its reactivity. It is also dried by heating to remove its moisture. These operations liberate dust and trace amounts of Radon-222 into the atmosphere and they constitute a significant source of air pollution.

Radon-222 is a gaseous naturally radioactive daughter of Radium-226 which is a naturally radioactive daughter in the uranium-238 decay chain. In an equilibrium mixture of radionuclides in this decay chain, the greatest alpha energy is contributed by Radon-222 and its alpha emitting daughters. Radon-222 can easily permeate the atmosphere. It is considered to be one of the most serious low level radiation hazards to health. The Radon-222 daughters are particulates which, when adsorbed on particles of dust that are inhaled, are prime contributors to the increased incidence of lung cancer.

It is imperative that the Randon-222 gas be contained throughout the mining and processing operations.

In reclaiming the land by contemporary methods, the sandy overburden and the leach zone overburden are randomly mixed as they are deposited in the mined out pits. Consequently, some of the decaying radioactive materials contained in the leach zone overburden may be found at or near the surface of the reclaimed lands. Some of these decaying radioactive materials emit gamma radiation.

The Radon-222 generated at depths of less than 10 feet will readily diffuse upward through the soil and through concrete foundations of structures built upon these reclaimed lands. The amount of Radon-222 diffusing into the atmosphere is determined by the amount of Radium-226 concentrated within the first 10 feet of the surface. Because of its long halflife, Radium-226 will continue to produce Radon-222 for many thousands of years.

Some of the decaying radioactive Radon daughters also emit gamma radiation. Consequently the gamma radiation levels on the reclaimed lands may be many times greater than the natural background radiation levels of the undisturbed lands.

This method of reclaiming land can and must be improved to eliminate radiation hazards to health.

Florida is one of five principal producers of phosphate in the world. It is the largest producer in the United States accounting for about 80% of the total production.

The Florida phosphate industry circulates approximately 1.67 billion gallons of water each day in performing the various steps in the phosphate mining and processing operation. Of this amount, the industry recycles about 85%. The remaining 15% or 250 million gallons of water must be withdrawn from the Floridan aquifer each and every day.

The Floridan aquifer has been dropping steadily at an alarming rate over the past few years. This is causing great concern.

This unreasonable and unrecoverable withdrawal of 250 million gallons of potable water from the Floridan aquifer represents an extremely severe problem and it is imperative that an immediate and effective solution be found.

It occurred to me that the several items that are causing great concern over the current methods of mining and processing phosphate are, namely:

(1) the extremely excessive withdrawal of potable water from the Floridan aquifer;

(2) the unsightly slime ponds that render large areas of land unusable for many years thus seriously impeding land reclamation and that pose the ever present possibility of polluting public waterways;

(3) the loss of finely divided phosphatic values in the clay slimes;

(4) air pollution; and (5) low level radiation hazards to health, could be eliminated if the phosphate ore is mined and processed in the dry state. It also occurred to me that the method utilized must be economically competitive with current methods using water. It further occurred to me that these factors causing great concern could be eliminated if the phosphate mining and processing operations are performed in a substantially closed system wherein the internal system pressure is less than the ambient atmospheric pressure using a gas moving at supersonic velocity as the carrier fluid.

Phosphate is essential to the health and welfare of mankind. Water is essential to the sustenance of life itself. With current technology the phosphate cannot be produced without sacrificing the water. A new technology is needed to resolve this dilema.

This new technology must also eliminate clay slimes, air pollution and low level radiation hazards, provide a method of reclaiming land to its natural state immediately and permit the recovery of all the phosphatic materials available in the mining area.

My invention provides just that technology.

A review of the prior art revealled several mining and processing operations that use air or inert gases as the carrier fluid. The disclosed system velocities ranged from less than 30 feet per second to near sonic velocity. All systems disclosed had geometric configurations that present serious limitations in their capacity to handle large mass flows. The methods of these systems are not competitive with current methods using water. Disclosed methods that rely on centrifugal force to seperate solids from gaseous streams are limited to handling low mass flows only, and they are not adaptable to processing the phosphate ore at the high mass flow rates required.

Generally, none of the prior art that I have reviewed is capable of mining and processing phosphate ore in a manner that is economically competitive with current methods using water as the carrier fluid. Moreover, no other method for mining and processing phosphate ore eliminates air pollution and low level radiation hazards to health and none provides immediate reclamation of land to its natural state.

SUMMARY OF THE INVENTION

A gas moving at supersonic velocity has an extremely high kinetic energy. A gas moving at supersonic velocity can transport larger quantities of solids suspended therein than it can moving at any other velocity, sonic or less. A gas moving at supersonic velocity has a pronounced drying effect on damp or wet solids.

In the present invention, and in its preferred embodiments, air moving at supersonic velocity is used as the carrier fluid to process the phosphate matrix, which may be damp, to produce dry high grade phosphate pebbles, to recover the fine phosphatic values contained with the sand and clay fractions, to produce dry sand and clay fractions, to mix the sand and clay as they are produced and to transport the mixture of sand and clay combined with the radioactive Radon-222 generated during the processing steps to the mined out area for burial of the radioactive materials and for immediate reclamation of land to its natural state.

The entire process is carried out in a closed system wherein the system internal pressure is maintained at a value less than that of the ambient atmospheric pressure to prevent air pollution.

Accordingly, it is an object of this invention to process the as-mined phosphate matrix in its dry state using air moving at supersonic velocity as the carrier fluid to produce dry clay fractions thus avoiding the formation of clay slimes and obviating the need for clay slimes retaining ponds.

It is another object of this invention to process the as-mined phosphate matrix in its dry state using air moving at supersonic velocity as the carrier fluid to recover the fine phosphatic values contained with the sand and clay fractions that are presently unrecoverable using current methods.

Yet another object of this invention to process the as-mined phosphate matrix in its dry state using air moving at supersonic velocity as the carrier fluid is to produce dry sand fractions.

A significant object of this invention to process the as-mined phosphate matrix in its dry state using air moving at supersonic velocity as the carrier fluid is to recombine the dry sand and clay fractions in approximately equal proportions by weight as they are produced and to convey the mixture combined with the naturally radioactive Radon-222 generated within the closed system to the mined out area for burial of the naturally radioactive wastes and to effect immediate reclamation of the land to its natural state.

A still more significant object of this invention to process the as-mined phosphate matrix in its dry state using air moving at supersonic velocity as the carrier fluid is to conserve the astronomical quantities of potable water presently consumed by current methods.

A further object of this invention to process the as-mined phosphate matrix in its dry state using a gas moving at supersonic velocity as the carrier fluid is to produce dry phosphatic materials without the use of ancillary drying equipment.

Still another object of this invention to process the as-mined phosphate matrix in its dry state using air moving at supersonic velocity as the carrier fluid is to avoid contamination of the atmosphere due to dust and naturally radioactive gases and airborne particulates by carrying out the complete process in a closed system wherein the system internal pressure is less than the ambient atmospheric pressure.

Other objects of this invention to process the asmined phosphate matrix in its dry state using air moving at supersonic velocity as the carrier fluid will become apparent to those skilled in the art where the teachings of this invention are made known to them.

It may also occur to those skilled in the art that the clay slimes contained in existing slime ponds may be pumped through conventional dewatering units and then processing the dewatered clays using the methods of this invention to recover the phosphatic values contained therein.

BRIEF DESCRIPTION OF THE DRAWINGS

FIG. 1 shows the effect of increasing nozzle expansion pressure ratio, $P_1/P_2$ on the ratio of supersonic velocity to sonic velocity, Vs/Va;

FIG. 2 schematically illustrates the means by which phosphate matrix is conveyed to the exit plane of a convergent-divergent nozzle from which air issues at supersonic velocity to propel the phosphate matrix through transmission lines;

FIG. 3 schematically illustrates the means by which the mass of particles comprised of phosphatic materials, sand and clay that were dislodged from the matrix are conveyed to the exit plane of a convergent-divergent nozzle from which air issues at supersonic velocity to propel the mass to a vortex chamber wherein the heavier particles are separated from the lighter particles by centrifugal force;

FIG. 4 schematically illustrates the means by which the sand-clay mixture combined with naturally radioactive wastes are dampened with water and deposited in the mined out pit;

FIG. 5 schematically portrays the flow diagram of the mining and processing of the phosphate matrix using the preferred embodiments of this invention;

FIG. 6 schematically portrays a typical cross section of the Florida land pebble district; and FIG. 7 schematically portrays a cross section of the preferred method of reclaiming the land to its natural state and to eliminate health hazards due to radioactive wastes.

DESCRIPTION OF THE PREFERRED EMBODIMENTS

The mass of a given fluid is directly proportional to its density, its velocity and to the cross-sectional area of its flow passage. Thus, for any given fluid and flow passage cross-sectional area, a large increase in flow velocity will yield a correspondingly large increase in mass flow.

The work done by a gas in expanding from an elevated pressure, $P_1$, to a lower pressure, $P_2$, is directly proportional to the pressure ratio, $P_1/P_2$. Conversely, the same amount of work has to be done on the gas in compressing it from the same said lower pressure $P_2$ to the same said elevated pressure $P_1$. Thus, for any given fluid and given initial conditions of temperature and volume, the horsepower required to compress a gas becomes larger as the pressure ratio becomes larger.

Fluid flow velocity can be made to increase continuously without expending additional energy by causing the fluid to flow through a convergent-divergent nozzle designed to accelerate the fluid from very low subsonic velocities approaching zero at the entrance to the convergent section of the nozzle to sonic velocity at its throat to supersonic velocity downstream of the throat in the divergent section of the nozzle reaching its largest value at the exit plane of the divergent section of the nozzle. In order to achieve this, it is necessary that the ratio between the nozzle inlet pressure, $P_1$, at the entrance plane of the convergent portion of the nozzle and the pressure, $P_t$, at the throat of the nozzle be equal to the critical pressure ratio, $P_1/P_t$, for the fluid in question and that the nozzle exit pressure, $P_2$, at the exit plane of the divergent section of the nozzle be less than the throat pressure such that the nozzle expansion ratio, $P_1/P_2$, is greater than the critical pressure ratio, $P_1/P_t$.

Optimum expansion is achieved when the nozzle exit pressure is equal to the ambient pressure. The magnitude of the supersonic velocity reaches its maximum design value at the exit plane of the divergent section of the nozzle when optimum expansion occurs.

The ratio of supersonic velocity to sonic velocity, Vs/Va, is a function only of the specific heat ratio of a given fluid and of the expansion ratio, $P_1/P_2$. This relationship, for air, is shown in FIG. 1. It is seen that the velocity ratio increases rapidly with increase in pressure ratio until a pressure ratio of about 20 is reached. Beyond that, the velocity ratio increases slowly with further increase in pressure ratio. This relationship clearly shows the superiority of supersonic flow over sonic flow.

At a pressure ratio of 20, for example, the velocity ratio is 1.86 which is to say that, at this pressure ratio, the magnitude of the supersonic velocity is 86% greater than the magnitude of the sonic velocity. Since the amount of power required to produce supersonic flow at any given pressure ratio is the same as the amount of power required to produce sonic flow at the same pressure ratio, it is clearly seen that, in this example, the supersonic flow is 86% more effective in doing work than is the sonic flow. Similar conclusions may be drawn for the other pressure ratios. This is a significant factor that makes it possible to transport more phosphatic materials through smaller conduits by means of this invention at the same power level that is required by other methods employing sonic flow, and many times more phosphotic materials than can be transported by any method employing subsonic flows.

Centrifugal force is directly proportional to the mass of a particle and to the square of its velocity and inversely proportional to its radius of rotation about a given axis. If the centrifugal force of a given particle rotating about a given axis at supersonic velocity, Vs, is compared to the centrifugal force developed by the same particle rotating about the same axis at sonic velocity, Va, it is seen that the ratio of said centrifugal forces is equal to the ratio of the square of the velocities, $(Vs/Va)^2$. For the aforementioned example, at a pressure ratio of 20, the square of the velocity ratio is 3.46 which is to say that, at this pressure ratio, the centrifugal force developed by a particle rotating about a given axis at supersonic velocity is 246% greater than the centrifugal force developed by the same particle rotating about the same axis at sonic velocity. Similar conclusions may be drawn for other pressure ratios.

This significantly important factor makes it possible to separate extremely small particles of slightly different masses from each other and is relied upon by this invention to recover the fine phosphatic values that are presently unrecoverable by methods heretofore in use.

It also makes it possible to produce more phosphatic materials at the same power level that is required by other methods employing sonic flow and many times more phosphatic materials than can be produced by any method employing subsonic flows.

The process of this invention is carried out in a closed system at a system internal pressure that is less than the ambient atmospheric pressure thus effectively preventing contamination of the atmosphere by any dust particles and airborne radioactive substances that are formed throughout the process.

Thus it is seen that the processing of the phosphate matrix in its dry state using a gas moving at supersonic velocity as the carrier fluid is superior to and more efficient than the processing of phosphate matrix using a gas moving at sonic velocity as the carrier fluid, and it is clearly many times more efficient than the processing of phosphate matrix by using a gas moving at subsonic velocity.

My invention is further explained by reference to FIGS. 1, 2, 3, 4, 5, 6 and 7.

Referring to FIGS. 5 and 6, an electrically powered dragline 1 strips the sandy overburden 72 and the leach zone overburden 73 exposing the underlying phosphate matrix 74 which lies over bedrock 75. The sandy overburden 72 is initially stacked in a pile 3 on natural ground adjacent to the mine pit 2 and the leach zone overburden 73 is initially stacked in a separate pile 3A on natural ground adjacent to mine pit 2. The matrix, which may be damp, is then deposited by said dragline 1 into hopper 4.

An apparatus, hereinafter to be called a compressor-nozzle unit shown more clearly in FIG. 2 and identified by the numeral 8 is comprised of a compressor 8A in communication with a convergent-divergent nozzle 8B. The compressor delivers a constant high volume flow of air at an elevated pressure $P_1$, greater than atmospheric pressure, to the inlet of the convergent-divergent nozzle which is dimensioned so that the air is continuously expanded to a lower pressure $P_2$, less than the ambient atmospheric pressure, at the exit plane of the divergent portion of the nozzle such that the expansion pressure ratio, $P_1/P_2$, is greater than the critical pressure ratio, $P_1/P_t$, for air, and is of such magnitude that the velocity of the air flow becomes supersonic in the divergent portion of the nozzle reaching its maximum design value at the exit plane thereof. The compressor-nozzle units used throughout the remainder of the system are identical to the compressor-nozzle unit 8 described above, and each is identified by an appropriate single numeral as it appears in the circuit.

The discharge end of hopper 4 is equipped with a spring loaded normally closed butterfly valve 5, the purpose of which is to maintain plenum chamber 6 substantially closed from the atmosphere. The weight of the phosphate matrix forces the bufferfly valve 5 open and the matrix falls through the plenum chamber 6 into a supply conduit 7 which is in communication with the exit plane of the compressor-nozzle unit 8 from which air issues at supersonic velocity to strike the matrix as it falls past the nozzle exit plane.

The supply conduit 7 is oriented so that its central axis along the direction of matrix flow makes an acute angle with the longitudinal axis of the supersonic flow issuing from the nozzle so that the matrix flow has a longitudinal velocity component colinear with the supersonic air flow. The very high impact force of the supersonic air stream causes the matrix to crumble, dislodging the phosphatic materials, sand and clay therefrom. Additionally, the mass of the dislodged particles is propelled by the supersonic air stream through transmission line 9 which is aligned so that its longitudinal axis is colinear with the longitudinal axis of the supersonic nozzle. As the dislodged particles flow through transmission line 9 at supersonic velocity, they are subjected to further attritioning by random collision with one another to form a comminuted mass of particles. The particles are also subjected to the drying action of the supersonic air flow and are thus dried in the process.

If the transmission distance between the mine pit 2 and a substantially closed chamber 12, which houses a series of screens, is great, one or more booster compressor-nozzle units may be placed in the transmission line therebetween to keep the mass moving at supersonic velocity. The booster compressor-nozzle unit 10 shown in FIGS. 2 and 5 schematically represents the plurality of boosters that may be placed in the transmission line.

A substantially closed chamber 12 which is in communication with transmission lines 11, 13 and 18 houses a series of screens so arranged that the comminuted mass of particles discharged from transmission line 11, which is in communication with booster compressor-nozzle unit 10, pass over and through the series of screens. The oversize which consists of phosphate pebbles pass over the screens into transmission line 13. The undersize which consists of fine phosphatic values, sand and clay fractions pass through the screens into transmission line 18.

Transmission line 13 is in communication with the exit plane of a booster compressor-nozzle unit 14 from which air issues at supersonic velocity to propel the phosphate pebbles from transmission line 13 through transmission line 15 into a plurality of substantially closed storage bins 16 wherein an internal pressure $P_2$, less than the ambient atmospheric pressure, is maintained by a vacuum pump 17. The storage bins internal pressure $P_2$, is equal to the nozzle exit pressure of the typical compressor-nozzle units used herein so that the nozzle operates at optimum expansion.

A conduit 17A is in communication with vacuum pump 17 and the suction side of the compressor of the booster compressor-nozzle unit 58. Air and the trace amounts of Radon-222 which are generated within the system upstream of, and within the substantially closed storage bins 16 and which collect therein, are evacuated by vacuum pump 17 and discharged through conduit 17A into the suction side of the compressor of booster compressor-nozzle unit 58.

Transmission line 18 is in communication with the exit plane of a booster compressor-nozzle unit 19 from which air issues at supersonic velocity to propel the screening undersize consisting of fine phosphatic values, sand and clay fractions through transmission line 20 into a plurality of substantially closed holding tanks 21 wherein the internal pressure is maintained at the aforementioned pressure $P_2$ by a vacuum pump 22.

A conduit 22A is in communication with vacuum pump 22 and the suction side of the compressor of compressor-nozzle unit 24. Air and the trace amounts of Radon-222 which are generated within the system upstream of, and within the substantially closed holding tanks 21, and which collect therein, are evacuated by vacuum pump 22 and discharged through conduit 22A into the suction side of the compressor of compressor-nozzle unit 24.

A conduit 23 is in communication with holding tanks 21 and with the exit plane of a booster compressor-nozzle unit 24 from which air and the trace amounts of Radon-222 issue at supersonic velocity to propel the mixture of fine phosphatic values, sand and clay fractions from conduit 23 through conduit 25 that is affixed tangentially to the periphery of first vortex chamber 26. The mixture enters the first vortex chamber 26 (also shown in FIG. 3) tangentially and swirls around its interior at supersonic velocity generating a very large centrifugal force that separates the sand fraction and phosphatic values of size comparable to the sand from the clay fraction and phosphatic values of size comparable to the clay. The clay fraction and phosphatic values of comparable size and of nearly the same mass are discharged from first vortex chamber 26 into conduit 27 which is affixed thereto and which is also in communication with the exit plane of a booster compressor-nozzle unit 28 from which air issues at supersonic velocity to propel the mixture of clay and phosphatic values of comparable size and of nearly the same mass from conduit 27 through conduit 29 that is affixed tangentially to the periphery of a second vortex chamber 30. The mixture enters second vortex chamber 30 tangentially and swirls around its interior at supersonic velocity generating a very large centrifugal force that seperates the phosphatic values from the clay fraction.

The phosphatic values are discharged from second vortex chamber 30 into conduit 31 which is affixed thereto and which is also in communication with the exit plane of a booster compressor-nozzle unit 32 from which air issues at supersonic velocity to propel the phosphatic values from conduit 31 through transmission line 33 to the plurality of substantially closed storage bins 16.

The clay fraction is discharged from second vortex chamber 30 to conduit 34 which is affixed thereto and which is also in communication with the exit plane of a booster compressor-nozzle unit 35 from which air issues at supersonic velocity to propel the clay fraction from conduit 34 through transmission line 36 into a plurality of substantially closed holding tanks 37 wherein the internal pressure is also maintained at the aforementioned pressure $P_2$ by a vacuum pump 38.

A conduit 38A is in communication with vacuum pump 38 and the suction side of the compressor of compressor-nozzle unit 55. Air and the trace amounts of Radon-222 which are generated within the system upstream of, and within the plurality of substantially closed holding tanks 37 and which collect therein, are evacuated by vacuum pump 38 and discharged through conduit 38A into the suction side of the compressor of the compressor-nozzle unit 55.

The mixture of sand and phosphatic values of comparable size and of nearly the same mass are discharged from first vortex chamber 26 into a conduit 39 which is affixed thereto and which is also in communication with the exit plane of a booster compressor-nozzle unit 40 from which air issues at supersonic velocity to propel the mixture of sand and phosphatic values of comparable size and of nearly the same mass from conduit 39 through conduit 41 which is affixed tangentially to a third vortex chamber 42. The mixture enters third vortex chamber 42 tangentially and swirls around its interior at supersonic velocity generating a very large centrifugal force that separates the phosphatic values from the sand. The phosphatic values are discharged from third vortex chamber 42 through conduit 43 which is affixed thereto and which is also in communication with the exit plane of a booster compressor-nozzle unit 44 from which air issues at supersonic velocity to propel the phosphatic values from conduit 43 through transmission line 45 to the plurality of substantially closed storage bins 16.

Vortex chambers 26, 30 and 42 are arranged to from a series-parallel configuration.

The sand fraction is discharged from third vortex chamber 42 through conduit 46 which is affixed thereto and which is also in communication with the exit plane of a booster compressor-nozzle unit 47 from which air issues at supersonic velocity to propel the sand fraction from conduit 46 through transmission line 48 to a plurality of substantially closed holding tanks 49 wherein the internal pressure is maintained at the aforementioned pressure $P_2$ by a vacuum pump 50.

A conduit 50A is in communication with vacuum pump 50 and the suction side of the compressor of compressor-nozzle unit 52. Air and the trace amounts of Radon-222 which are generated within the system upstream of and within the substantially closed holding tanks 49 and which collect therein, are evacuated by vacuum pump 50 and discharged through conduit 50A into the suction side of the compressor of compressor-nozzle unit 52.

Conduit 51 is in communication with sand holding tanks 49 and also with the exit plane of a booster compressor-nozzle unit 52 from which air and the trace amounts of Radon-222 issue at supersonic velocity to propel the sand from conduit 51 through transmission line 53.

Conduit 54 is in communication with clay holding tanks 37 and also with the exit plane of a booster compressor-nozzle unit 55 from which air and the trace amounts of Radon-222 issue at supersonic velocity to propel the clay from conduit 54 through transmission line 56.

Transmission lines 53 and 56 are in communication with each other and with transmission line 57. The sand propelled by booster compressor-nozzle unit 52 through transmission line 53 and the clay propelled by booster compressor-nozzle unit 55 through transmission line 56 meet and recombine in transmission line 57 in approximately equal proportions by weight. This may be accomplished by sizing the transmission lines in accordance with well known methods of fluid dynamics.

Transmission line 57 is in communication with the exit plane of a booster compressor-nozzle unit 58 from which air and the trace amounts of Radon-222 issue at supersonic velocity to propel the mixture of sand and clay combined with the trace amounts of Radon-222 from transmission line 57 through transmission line 67 to a plurality of substantially closed holding tanks 68 wherein the internal pressure is maintained at the aforementioned pressure $P_2$ by a vacuum pump 69.

A conduit 69A is in communication with vacuum pump 69 and the suction side of the compressor of compressor-nozzle unit 70. Air and the trace amounts of Radon-222 which are generated within the system upstream of, and within the substantially closed holding tanks 68 and which collect therein, are evacuated by vacuum pump 69 and discharged through conduit 69A into the suction side of the compressor of compressor-nozzle unit 70.

A conduit 71 is in communication with holding tanks 68 and also with the exit plane of the compressor-nozzle unit 70 from which air and the trace amounts of Radon-222 issue at supersonic velocity to propel the sand-clay mixture and the trace amounts of Radon-222 contained therewith from conduit 71 through transmission line 59 to hopper 60 which is located at the mined out pit 2.

As shown schematically in FIG. 4, a flexible line 61 is interposed between hopper 60 and transmission line 59 to permit lateral and vertical movements of hopper 60 by conventional mechanisms not shown in the figure. A spring loaded normally closed butterfly valve 62 located in a fixed section of pipe between hopper 60 and flexible line 61 maintains transmission line 59 and flexible line 61 substantially closed from the atmosphere. Plenum chamber 63 is in communication with hopper 60 and with a smaller flexible line 64 through which water, from a source not shown in the figure, flows to an annular passage 65 which surrounds the plenum chamber 63 and which is in communication with a plurality of spray nozzles 66 equally spaced around the interior of plenum chamber 63.

As the trace amounts of Radon-222 and the sand-clay mixture flow through flexible line 61, butterfly valve 62 is forced open. The sand-clay mixture and the trace amounts of Radon-222, which is heavier than air, then enter hopper 60 and drop therefrom into plenum chamber 63 wherein the combination is dampened with water issuing from spray nozzles 66. Only a small amount of water is used sufficient to prevent the formation of dust as the sand-clay mixture and the trace amounts of Radon-222 contained therewith, fall by gravity onto the bedrock 75 of the mined out pit 2. The hopper is moved laterally and vertically to uniformly distribute the damp mixture in the mined out pit 2 until a prescribed elevation is reached. The operation is preformed so that the damp mixture 76 will have sloping walls that form a first central cavity in the mixture in the area in which a lake is to be formed as shown in FIG. 7.

Referring to FIGS. 5 and 7, the dragline 1 then removes the leach zone overburden initially stacked in pile 3A and deposits it in hopper 60. The leach zone overburden then falls into plenum chamber 63 wherein it is dampened with sufficient water issuing from spray nozzles 66 to prevent the formation of dust as the leach zone overburden falls by gravity onto the sand-clay mixture and the trace amounts of Radon-222. The hopper 60 is moved laterally and vertically to distribute the damp leach zone overburden over the sand-clay mixture and the trace amounts of Radon-222 until a prescribed elevation is reached. Moreover, the operation is performed in such a manner that the leach zone overburden 77 will, in the area in which a lake is to be formed, have sloping walls that form a second central cavity that is continuous and coaxial with the said first central cavity.

The dragline 1 then removes the sandy overburden initially stacked in pile 3 and deposits it into hopper 60. The sandy overburden then falls into plenum chamber 63 wherein it is dampened with sufficient water issuing from spray nozzles 66 to prevent the formation of dust as the sandy overburden falls by gravity onto the leach zone overburden. The hopper 60 is moved laterally and vertically to uniformly distribute the sandy overburden over the leach zone overburden until a prescribed elevation is reached. Moreover, the operation is performed in such a manner that the sandy overburden 78 will, in the area in which a lake is to be formed, fill the said first and said second central cavities and to form a third central cavity having sloping walls, said third central cavity being coaxial with, and interior to said first and said second central cavities.

Finally the said third central cavity is filled with water to form a lake 79.

The thickness of the sandy overburden cover 78 over the leach zone overburden 77 and between the lake 79 and the sloping walls of the leach zone overburden 77 and the sand-clay mixture 76 is preferred to be not less than 20 feet.

This preferred thickness of sand overburden cover will prevent the diffusion of Radon-222 to the surface of the ground and to the lake. Moreover, it will also substantially attenuate the gamma rays radiating to the surface of the ground and to the lake to radiation levels that approximate or are less than the natural background radiation levels that existed before the land was disturbed by mining.

The size, depth and the number of lakes and the elevation of each fill operation shall be as prescribed in a master plan for reclaiming the land. Said plan shall take into consideration the volume of phosphatic material removed and the volume of sandy overburden required to provide not less than 20 feet of cover over the buried naturally radioactive wastes.

Thus the land can be reclaimed naturally, immediately and without danger of low level radiation to life.

Each vacuum pump used in the system is equipped with a set of filters that collect the dust formed throughout the proces. The dust so collected may include phosphatic values that may be of sufficient quantity to warrant secondary processing using the methods of this invention to recover said phosphatic values. Otherwise, the dust particles are collected and placed in suitable containers which may be conveyed to the mined out pit for burial therein along with the sand-clay mixture or the leach zone overburden.

The preferred embodiments of this invention permit the accomplishment of all objectives specified.

The foregoing description of the preferred embodiments of this invention is illustrative. There may be many variations and modifications made to the present invention by those skilled in the art when the aforementioned teachings are made known to them, and such changes may be made without departing from the spirit of this invention as defined in the following claims.

I claim:

1. A method of processing as mined dry or damp phosphate matrix comprising:

(a) depositing dry or damp phosphate matrix from a mine pit into a stream of carrier gas moving at supersonic velocity;

(b) comminuting said phosphate matrix by the high impact force of said gas moving at supersonic velocity to form a loosely held heterogeneous mass of phosphatic materials, sand and clay, said phosphatic materials comprising phosphate pebbles and finer phosphatic values;

(c) drying said mass of phosphatic materials, sand and clay, with said gas;

(d) transporting said mass of phosphatic materials, sand and clay in said gas at supersonic velocity to a first separation zone to separate said phosphate pebbles from a residual mixture of said finer phosphatic values, sand and clay;

(e) transporting said phosphate pebbles to storage bins at supersonic velocity;

(f) transporting said mixture of finer phosphatic values, sand and clay at supersonic velocity to a plurality of different separating zones arranged in a series-parallel configuration wherein the phosphatic values, sand and clay, are separated from each other by centrifugal force at supersonic velocity;

(g) transporting said phosphatic values at supersonic velocity to storage bins;

(h) recombining said sand and clay in approximately equal proportions by weight at supersonic velocity;

(i) collecting the Radon-222;

(j) combining said recombined mixture of sand and clay with said Radon-222 at supersonic velocity;

(k) transporting said recombined mixture of sand and clay and said Radon-222 at supersonic velocity to the mined out pits; and (l) depositing said recombined mixture and said Radon-222 therein.

2. The method of claim 1, wherein the as-mined dry or damp phosphate matrix which is initially subjected to the very high impact force of a gas moving at supersonic velocity is further comminuted by random collision of said particles with one another at supersonic velocity while being dried by the drying action of said gas moving at supersonic velocity, said mass of dry particles are transported to a series of screens of a size permitting the phosphate pebbles to pass thereover and an undersize comprising fine phosphatic values, sand and clay, to pass therethrough, said phosphate pebbles are transported at supersonic velocity to storage bins while concurrently transporting the mixture of fine phosphatic values, sand and clay to a first vortex chamber wherein said mixture of fine phosphatic values, sand and clay are swirled at supersonic velocity to generate a centrifugal force to cause heavier particles to be separated from lighter particles in said mixture, said heavier particles comprising clay and phosphatic values of size comparable to the clay and of nearly equal mass, said heavier particles are then transported at supersonic velocity to a second vortex chamber wherein said clay is separated from said phosphatic values of size comparable to the clay and of nearly the same mass and concurrently said lighter particles comprising the sand and phosphatic values of size comparable to the sand and of nearly the same mass are transported at supersonic velocity to a third vortex chamber wherein the sand is seperated from the phosphatic values of size comparable to said sand and of nearly the same mass, the phosphatic values produced in said second and third vortex chambers are transported at supersonic velocity to storage bins and the clay produced in said second vortex chamber and the sand produced in said third vortex chamber and the trace amounts of Radon-222 generated within the closed system are transported at supersonic velocity to a common conduit wherein the sand and clay are recombined in approximately equal proportions by weight thoroughly mixed and combined with said Radon-222 prior to being transported at supersonic velocity to the mined out pits and therein deposited.

3. The process of claim 2 wherein all transport functions are performed by a gas moving at supersonic velocity.

4. The process of claim 2 wherein all seperation functions are performed by a gas moving at supersonic velocity.

5. A continuous process for mining of phosphatic matrix which comprises:

(a) removing the overburden from a bed of underlying phosphate bearing matrix to expose said underlying phosphate matrix;

(b) depositing dry or damp as mined phosphate matrix into a stream of carrier gas moving at supersonic velocity;

(c) comminuting said as-mined dry or damp phosphate matrix by the high impact force of said gas moving at supersonic velocity to form a loosely held heterogeneous mass of particles comprising phosphate pebbles, finer phosphatic values, sand and clay;

(d) simultaneously drying said heterogeneous mass of particles of phosphate pebbles, phosphatic values, sand and clay, with said gas moving at supersonic velocity;

(e) further comminuting said heterogeneous mass of particles of phosphate pebbles, phosphatic values, sand and clay, by random collision with one another as they are borne by said gas;

(f) transporting said heterogeneous mass of particles of phosphate pebbles, phosphatic values, sand and clay in said gas at supersonic velocity to a series of screens to separate said phosphate pebbles from a mixture of phosphatic values, sand and clay;

(g) transporting said phosphate pebbles at supersonic velocity to storage bins;

(h) transporting said mixture of phosphatic values, sand and clay, in said gas at supersonic velocity to a first vortex chamber wherein said mixture of phosphatic values, sand and clay is swirled at supersonic velocity to generate a centrifugal force to cause heavier particles comprising the clay and phosphatic values of size comparable to the clay and of nearly the same mass to be separated from lighter particles comprising the sand and phosphatic values of size comparable to the sand and of nearly the same mass;

(i) transporting said mixture of clay and phosphatic values of size comparable to the clay and of nearly the same mass in said gas at supersonic velocity to a second vortex chamber to separate said phosphatic values of size comparable to the clay and of nearly equal mass from the clay;

(j) transporting said mixture of sand and phosphatic values of size comparable to the sand and of nearly the same mass in said gas at supersonic velocity to a third vortex chamber to separate said phosphatic values of size comparable to the sand and of nearly the same mass from the sand;

(k) transporting the clay separated in said second vortex chamber in said gas at supersonic velocity and concurrently transporting the sand separated in the third vortex chamber in said gas at supersonic velocity, and concurrently transporting the Radon-222 generated within the closed system in said gas at supersonic velocity to a common conduit and recombining and thoroughly mixing the sand and clay in approximately equal proportions by weight and combining said sand-clay mixture with said Radon-222;

(l) transporting the phosphatic values produced in the second vortex chamber in said gas at supersonic velocity to storage bins;

(m) transporting the phosphatic values produced in the third vortex chamber in said gas at supersonic velocity to said storage bins;

(n) transporting the sand-clay mixture and the Radon-222 in said gas at supersonic velocity to the mined out pits and depositing them therein;

(o) then depositing the removed leach zone overburden over the sand-clay mixture and the Radon-222 in the mined out pits;

(p ) then depositing the removed sandy overburden over the leach zone overburden in the mined out pits;

(q) forming a central cavity in said deposited materials in the mined out pits; and (r) then filling said central cavity with water to form a lake to complete the immediate reclamation of the land.

* * * * *